US005823717A

United States Patent [19]

Bastick et al.

[11] Patent Number: 5,823,717

[45] Date of Patent: Oct. 20, 1998

[54] FACING PANEL FOR EARTH STRUCTURES

[75] Inventors: Michel J Bastick, Puteaux; Alain Gorce, Croissy Sur Seine; Jean-Marc Jailloux, Sannois; Pierre Segrestin, Saint Germain en Laye; Paul Schodts, Lagnieu, all of France

[73] Assignee: Societe Civile des Brevets Henri Vidal, Paris, France

[21] Appl. No.: 793,791

[22] PCT Filed: Sep. 1, 1995

[86] PCT No.: PCT/GB95/02062

§ 371 Date: May 13, 1997

§ 102(e) Date: May 13, 1997

[87] PCT Pub. No.: WO96/06983

PCT Pub. Date: Mar. 7, 1996

[30] Foreign Application Priority Data

Sep. 1, 1994 [GB] United Kingdom ..... 9417573

[51] Int. Cl.[6] ..... E02D 29/02

[52] U.S. Cl. ..... 405/286; 405/284; 405/262

[58] Field of Search ..... 405/284, 285, 405/286, 262, 272, 273

[56] References Cited

U.S. PATENT DOCUMENTS 3,686,873 8/1972 Vidal .
4,718,792 1/1988 Louis .
4,968,186 11/1990 Ogorchock ..... 405/286 X
5,131,791 7/1992 Kitziller .
5,259,704 11/1993 Ogorchock .

FOREIGN PATENT DOCUMENTS 0130949 1/1985 European Pat. Off. .

*Primary Examiner*—Dennis L. Taylor
*Attorney, Agent, or Firm*—Banner & Witcoff Ltd.

[57] ABSTRACT

A facing panel (1) is provided for assembly with like facing panels to form a facing of a stabilized earth structure. The facing panel has two opposed side edges (2) for arrangement edge-to-edge with the side edges of laterally adjacent facing panels, each side edge having a front portion (5) which is straight over substantially the full height of the facing panel, and a rear portion comprising a lateral projection (8) over part of its length and an abutment (6, 7) over another part of its length, the lateral projection being provided for engagement behind a respective abutment on the side edge of a laterally adjacent facing panel to restrain forward movement of the facing panel, and the abutment being provided for engagement in front of a respective lateral projection of said laterally adjacent facing panel or of another laterally adjacent facing panel to restrain rearward movement of the facing panel.

18 Claims, 4 Drawing Sheets

FIG. 1
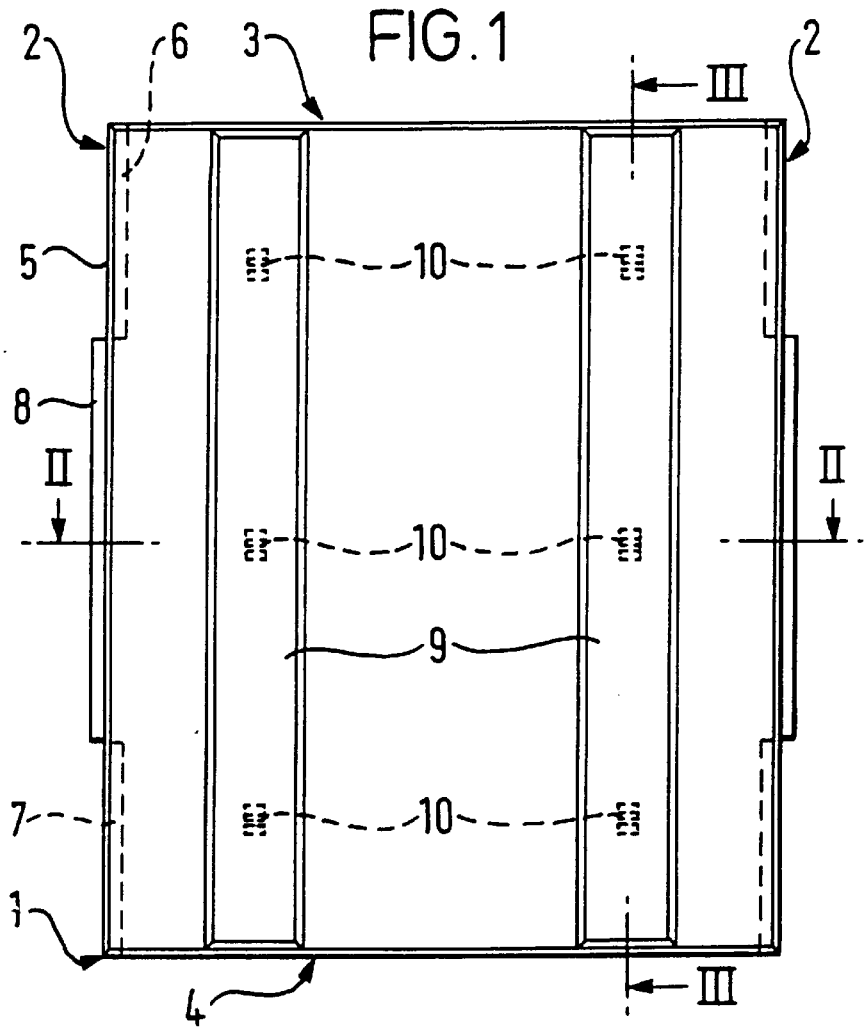
FIG. 2
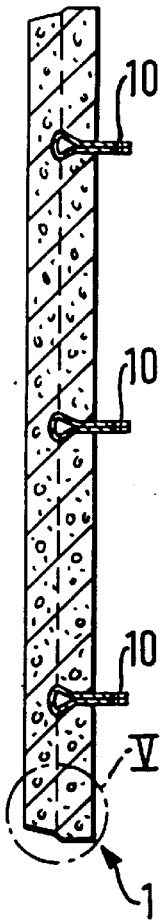
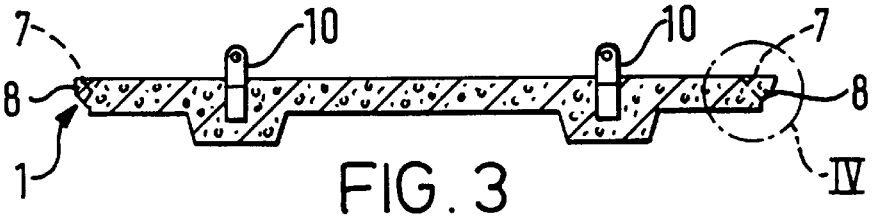
FIG. 3
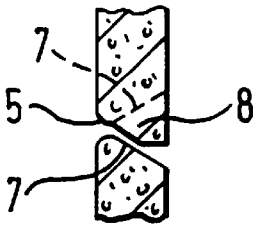
FIG. 4
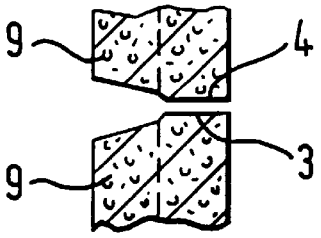
FIG. 5

FIG. 6
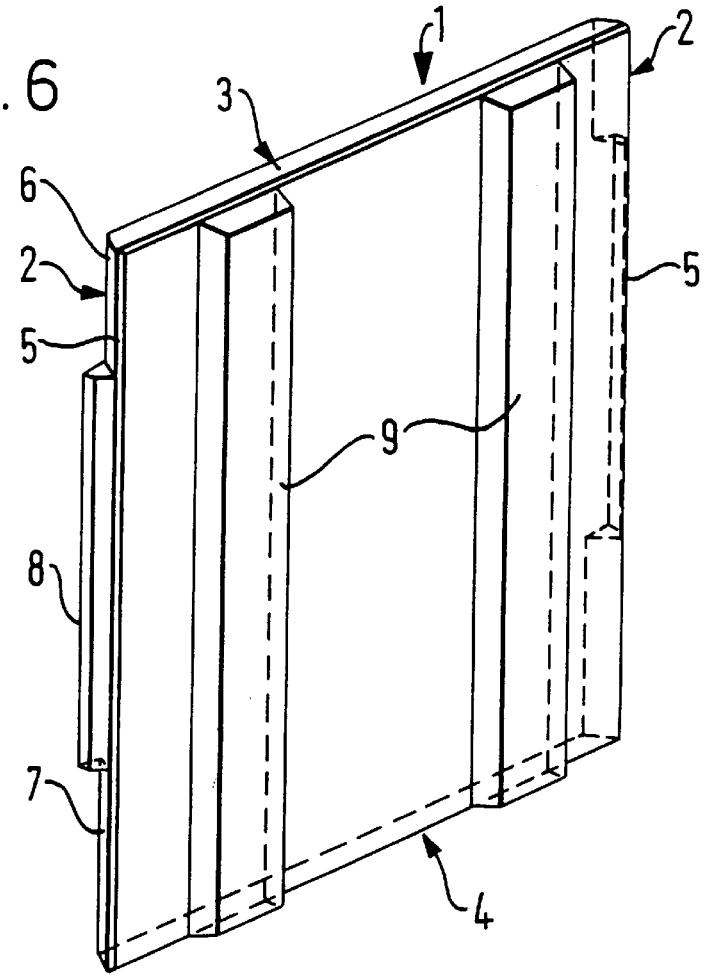
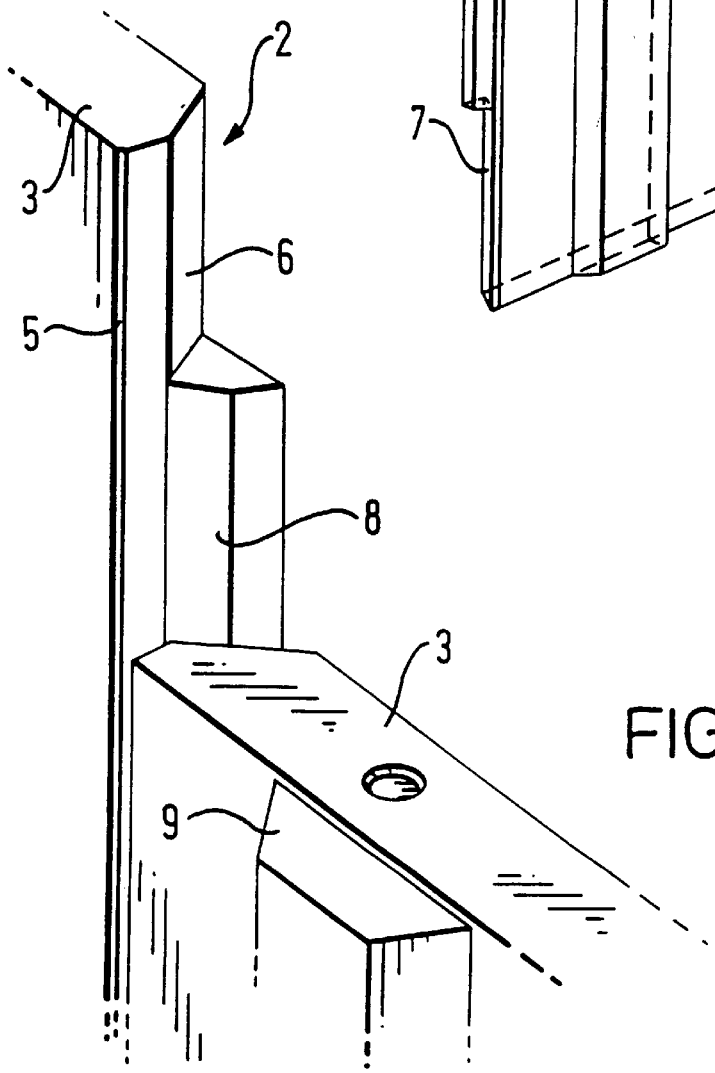
FIG. 7

FACING PANEL FOR EARTH STRUCTURES

The invention relates to facing panels for assembly to form a facing of a stabilised earth structure.

In one type of known stabilised earth structure, the earth is stabilised by a plurality of elongate stabilising elements extending rearwardly from a facing of the structure into an earth mass. In such structures the earth is stabilised throughout the mass by frictional engagement with the stabilising elements which may be in the form of strips or grids. Commonly, the facing of the structure consists of concrete panels which are connected to the forward ends of the strips or grids.

It is known from GB-A-1 324 686 (see FIGS. 2 to 7) to provide concrete panels which are generally cruciform shaped and interlock to form the facing. These are technically very good and have been successful but they can be expensive, partly because they are complicated to mould, and for certain structures a less costly facing may be desired. Moreover, from the front the facing appears as an array of interlocking cruciform shapes and whilst this imparts an attractive appearance to the facing, in some circumstances it may be desired to provide facing panels which present a more simple appearance from the front.

Rectangular and square facing panels are also disclosed in GB-A-1 324 686 (see FIGS. 8 to 11 and 29 to 31). The engagement between the side edges of these panels is by a half-lap joint over substantially the full height of the panels. Such a joint serves to restrain forward or rearward movement of a given panel side edge relative to the laterally adjacent panel side edge, but the joint does not restrain both forward and rearward movement. A type of side edge joint which does restrain both forward and rearward movement between laterally adjacent panels is a tongue and groove joint. However, this is difficult to mould and generally requires a thicker panel than, say, where a half-lap joint is used, in order to ensure an adequate thickness for the tongue and the flanges which form the groove.

According to the invention, there is provided a facing panel for assembly with like facing panels to form a facing of a stabilised earth structure, the facing panel having two opposed side edges for arrangement edge-to-edge with the side edges of laterally adjacent facing panels, each side edge having a front portion which is straight over substantially the full height of the facing panel, and a rear portion comprising a lateral projection over part of its length and an abutment over another part of its length, the lateral projection being provided for engagement behind a respective abutment on the side edge of a laterally adjacent facing panel to restrain forward movement of the facing panel, and the abutment being provided for engagement in front of a respective lateral projection of said laterally adjacent facing panel or of another laterally adjacent facing panel to restrain rearward movement of the facing panel.

The invention also extends to a facing of a stabilised earth structure, comprising a plurality of facing panels as defined herein, and to a stabilised earth structure having such a facing.

By providing each side edge with a front portion which is substantially straight, the facing can present a relatively simple appearance from the front, giving freedom of choice of architectural finish. For example, if the facing panel has substantially straight top and bottom edges, the panel will be rectangular or square. Alternative profiles for the top and bottom edges are however possible, if desired for architectural reasons.

Whilst permitting a simple appearance, the form of each side edge advantageously provides restraint at that edge against both forward and rearward movement relative to a laterally adjacent facing panel or panels. This is achieved by providing the side edge with a rear portion comprising a lateral projection over part of its length and an abutment over another part of its length. Because the lateral projection and the abutment are at different parts of the length of the side edge, the facing panel can be relatively thin compared to, for example, a facing panel with tongue and groove side edges. Such a panel with e.g. a 9 cm thickness near its side edges would have a tongue at one side edge and two flanges (defining the groove) at the other side edge each approximately 3 cm in thickness. The tongue and the flanges would be difficult to cast, would chip easily, and would not provide sufficient resistance to relative forward and rearward movement of laterally adjacent panels. Hence the panel would have to be thicker. In contrast, a preferred embodiment of facing panel according to the invention has a thickness near its side edges of 9 cm.

A facing assembled from the facing panels of the invention preferably comprises rows of panels with the panels in each row spaced apart by the width of a panel, and with a lower part of a panel of the next row being received in the space. This gives the advantage during construction that each panel can be lowered between two panels already installed in the row below. Each laterally extending joint between vertically adjacent panels is thus vertically offset from neighbouring laterally extending joints. Thus, the laterally extending joints are staggered.

Alternatively, however, the laterally extending joints may be aligned to produce "continuous" lateral joints across the facing, although this will normally require the use of clamps to secure each facing panel in position before it is attached to earth stabilising means behind the facing.

The facing panel may have lateral projections over the upper half of each side edge and abutments over the lower half of each side edge. Such a panel is generally "T" shaped in rear elevation. The panels can be assembled to form a facing with aligned laterally extending joints, with each panel inverted relative to the laterally adjacent panels. In preferred forms of assembly of such facing panels, however, all the panels are head-up or they are all upside down, both arrangements producing vertically offset laterally extending joints. Thus, the lateral projection of a side edge of a first panel engages behind the abutment of a side edge of a second panel laterally adjacent to the first panel, and the abutment of the same side edge of the first panel engages in front of the lateral projection of a side edge of a third panel also laterally adjacent to the first panel, the third panel being either above or below the second panel. Since the side edge engagement only restrains both forward and rearward movement once both the second and the third panels are installed, during construction it is preferable to use temporary clamps between the side edges of a freshly lowered panel and the panels between which it has been lowered.

Another form of facing panel has at one side edge a lateral projection over its lower half and an abutment over its upper half, and at its other side edge a lateral projection over its upper half and an abutment over its lower half. Such a panel is generally "Z" shaped in rear elevation. It can be assembled to form a facing with aligned laterally extending joints.

In a preferred facing panel, each side edge rear portion has upper and lower abutments respectively over upper and lower parts of its length and a said lateral projection over an intermediate part of its length. Such a panel is generally cruciform shaped in rear elevation. During construction with this form of facing panel, when a panel is lowered between two already installed panels, the side edges of the freshly lowered panel will engage with the upper abutments and an upper region of the lateral projections of the two panels already installed. This provides guidance during lowering of the panel and restraint against forward and rearward movement of the freshly lowered panel at the side edges thereof.

The height of the intermediately positioned lateral projection is preferably equal to half the height of the facing panel, so that in a facing the lateral projections of a panel will rest on the lateral projections of the laterally adjacent panels in the row below. The height may however be less, creating a vertical gap between lateral projections in a facing. The lateral projection is preferably centred. For example, the height of the upper and lower abutments may both be one quarter the height of the panel and the height of the lateral projection may be one half the height of the panel. Other arrangements, with the lateral projection not centred, are also possible. For example, the height of the upper abutment may be one sixth the height of the panel, the height of the lateral projection may be one half the height of the panel, and the height of the lower abutment may be one third the height of the panel.

In a facing assembled from the facing panels of the invention, the laterally extending joint between vertically adjacent panels is preferably positioned at mid height of the laterally adjacent panels. With such an arrangement, the amount of support given to a panel lowered between two already installed panels is always the same. It is however possible for the lateral joint to be at other positions relative to the laterally adjacent panels, for example at one third the height for one row and two thirds the height for the next row, and so on. This means that some panels will be lowered past the already installed panels through only one third of their height and will enjoy less support initially than those in the next row which will be lowered through two thirds of their height. However, such an arrangement may be desirable to achieve a particular architectural effect.

The top, bottom and side edges of the facing panel are preferably such that the panel can be arranged in the facing in either one of two orientations. If an asymmetrical architectural finish is used on the front of the panel it can be used either head-up or upside down to give the facing a desired appearance. With the cruciform panels having a centred lateral projection, or with the "Z" shaped panels, there is freedom to choose the orientation of each panel regardless of its position in the facing, in order to produce the desired architecural effect.

With certain embodiments, when a facing panel has been lowered into position between two already installed panels, there may be a tendency for pivotal movement to occur, for example about a horizontal axis located where the lateral projections of the panel rest on those of the already installed panels. For the embodiments which are cruciform shaped in rear elevation, the tendency is for the lower part of the panel to pivot forwardly. Preferably, therefore, the facing panel comprises means at the bottom edge of the facing panel for restraining forward or rearward movement thereof relative to a facing panel therebelow. Such means can serve to stop the pivotal movement and improve the stability of the panel before it has been attached to an earth stabilising element or elements. The means may be provided integrally with the panel, for example being a recess on the bottom edge engageable by a vertical projection on the top edge of the panel below. However, for ease of manufacture (it being preferred to mould the facing panel from a hardenable material such as concrete), the means comprises a shear resistant bearing pad which is separate from the main body of the facing panel and which in use is to be partly located in a recess formed in the bottom edge of the facing panel and to be partly located in a recess formed in the top edge of the facing panel below. It is therefore simply necessary to form the bottom and top edges with the recesses and otherwise these edges can be of a simple profile, for example generally flat.

It is sometimes desired to construct a facing which is curved in plan view. Preferably, therefore, the side edges of the facing are such as to permit adjacent facing panels to form a curve in plan view. In effect, this means that during construction adjacent panels are pivotally adjustable relative to each other whilst still achieving the required engagement of lateral projection and abutment.

As mentioned above, the side edge joints permit the facing panel to be relatively thin. However, extra thickness may be required where the panel is to be connected to earth stabilising means. A preferred facing panel therefore comprises means for connecting the panel to earth stabilising means behind the facing and has a thickness which is greater at a region where the connecting means is provided than at a region where it is not provided. For example, the facing panel may have at least two thickened ribs along which a plurality of connecting means are located. Such ribs may be positioned on the panel to stiffen it at zones of maximum bending moment, enabling the average thickness of the panel to be reduced. Thus the extra thickness of the panel can serve two functions: improved anchorage of the connecting means and increased bending resistance at zones of maximum bending moment.

It may be desired for the lateral projection to have a vertical cylindrical aperture lined with a plastics or metal sleeve, for receiving a pin projecting from the lateral projection of an adjacent panel to form a connection therewith. However, the provision of the sleeves and pins during a moulding manufacturing method of the panels adds complexity. Preferably, therefore, a facing panel is made by moulding and has no insert moulded therein other than means for connecting the facing panel to earth stabilising means behind the facing. Again, this simplifies the moulding procedure.

Certain preferred embodiments of the invention will now be described by way of example and with reference to the accompanying drawings, in which:

FIG. 1 is a front elevation of a facing panel;

FIG. 2 is a cross sectional view on the lines II—II of FIG. 1;

FIG. 3 is a cross sectional view on the lines III—III of FIG. 1;

Figure 8:
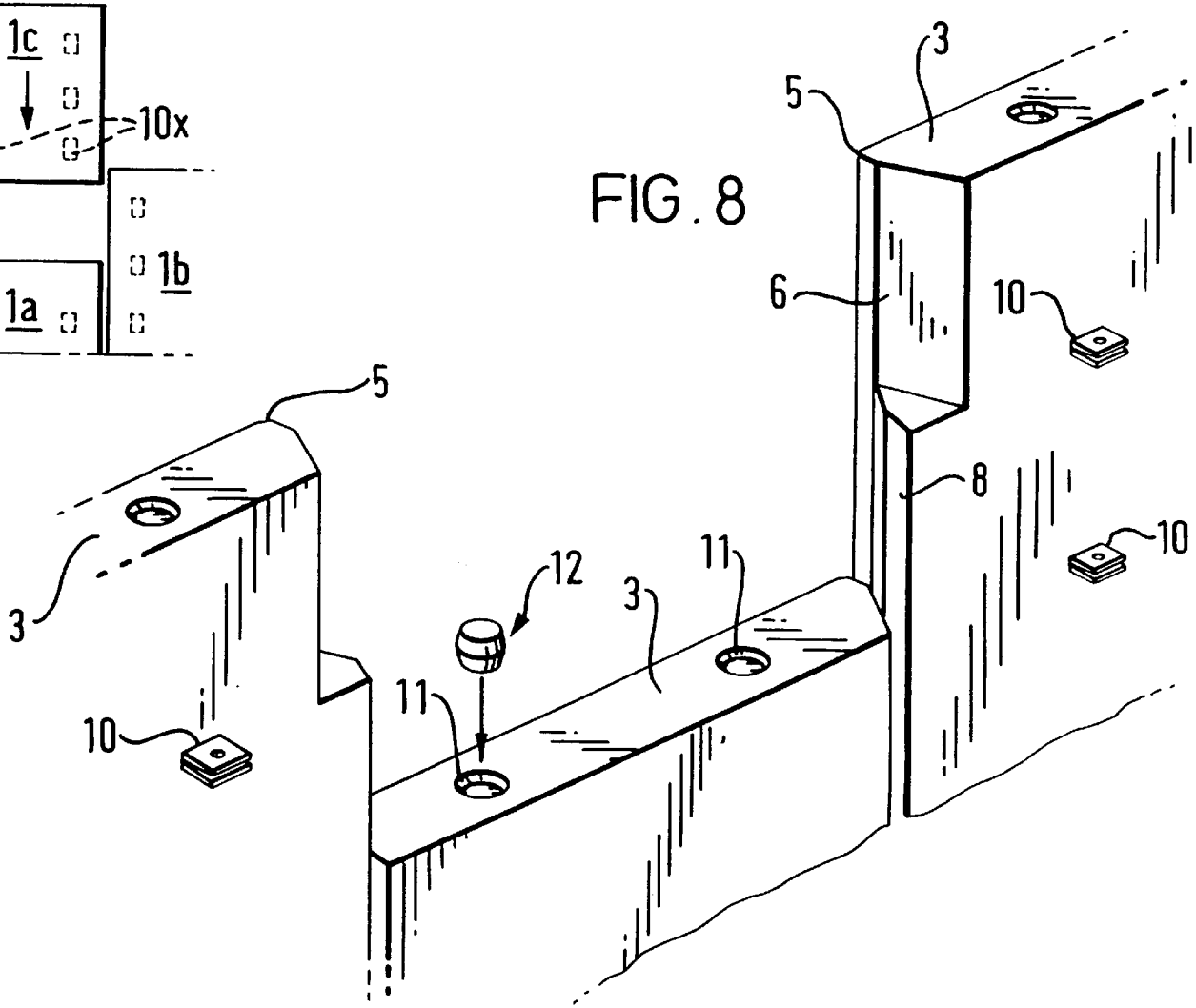
Figure 9:
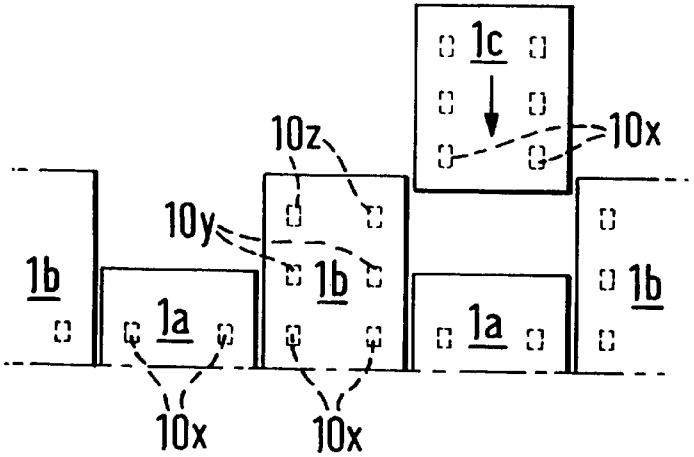
Figure 10:
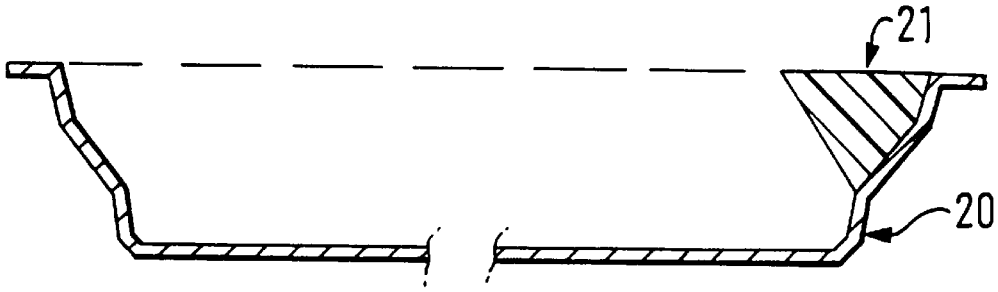
Figure 11:
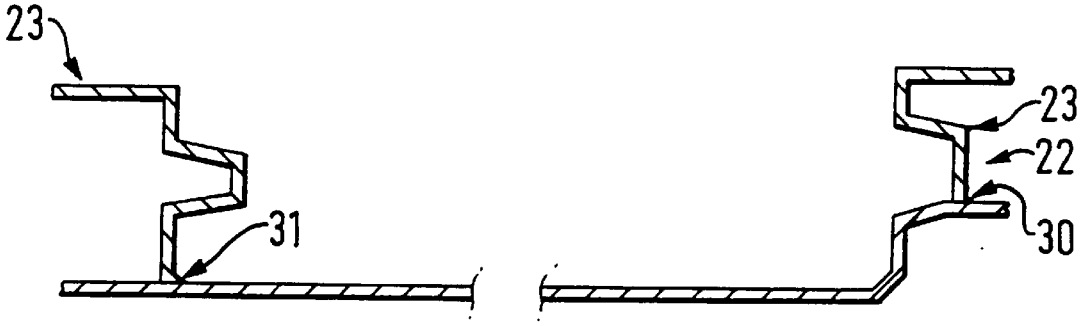
Figure 12:
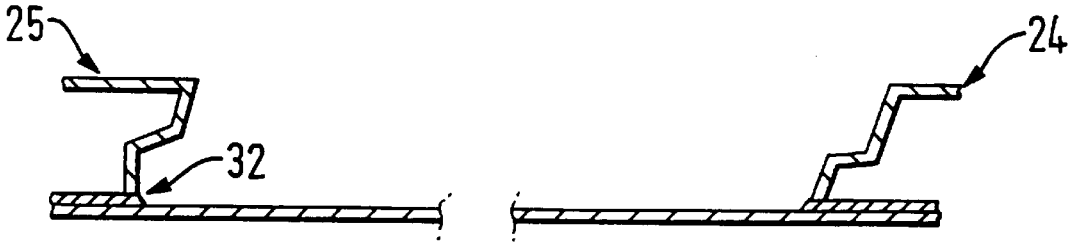
Figure 13:
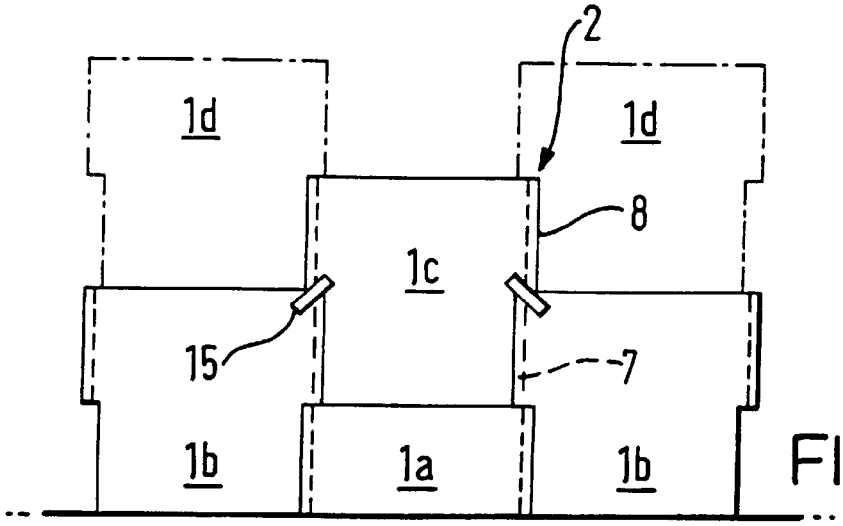

FIG. 4 corresponds to detail IV shown in FIG. 1 and shows a cross sectional view of the side edges of laterally adjacent facing panels;

FIG. 5 correspond to detail V shown in FIG. 3 and shows a cross sectional view of the top and bottom edges of vertically adjacent facing panels;

FIG. 6 is a perspective view of a facing panel;

FIG. 7 is a front perspective view of adjacent facing panels during construction;

FIG. 8 is a rear perspective view of adjacent facing panels during construction;

FIG. 9 is a front elevation view showing the construction sequence of the facing panels;

FIG. 10 is a cross sectional view through a mould for forming a facing panel in accordance with the invention, showing parts of the mould which form the facing panel side edges;

FIG. 11 is a cross sectional view similar to that of FIG. 10 but showing a mould for forming a known facing panel with a tongue and groove joining system at the side edges;

FIG. 12 is a cross sectional view similar to that of FIG. 10 but showing a mould for forming a known cruciform shaped facing panel; and FIG. 13 is a rear elevation view showing part of a facing made up from a modified form of facing panel in accordance with the invention.

Referring to FIGS. 1 to 8, a facing panel 1 has two opposed side edges 2, a top edge 3 and a bottom edge 4. Each side edge 2 has a front portion 5 in the form of a chamfer which is straight over the full height of the facing panel, and a rear portion which comprises an upper abutment surface 6 over an upper part of the length of the rear portion, a lower abutment 7 over a lower part of the length of the rear portion and a lateral projection 8 over an intermediate part of the length of the rear portion. The lateral projection is provided centrally of the length of the rear portion and is slightly less in length than the sum of the lengths of the upper and lower abutments 6,7, in order to allow for vertical adjustment between vertically adjacent panels during construction (as described later in relation to FIGS. 7 and 8). However, in other embodiments the lateral projection need not be centrally located, although it will have a length which is less than half the height of the facing panel.

The facing panel has on its front face two vertically extending thickened ribs 9, the primary purpose of which is to provide adequate thickness for a plurality of vertically spaced connecting lugs 10 which are embedded in the panel and project rearwardly therefrom. In this embodiment, three connecting lugs 10 are provided at intervals along the length of each of two thickened ribs 9, although different numbers of thickened ribs and connecting lugs are of course possible. The connecting lugs 10 are provided to form a connection with earth stabilising strips or other forms of earth stabilising means in a known manner.

As seen in FIGS. 7 and 8, the top edge 3 of the facing panel includes a pair of laterally spaced recesses 11. A shear resistant bearing pad 12 is provided for location in each recess 11, in such a manner that it projects upwardly from the top edge 3 ready to engage in corresponding laterally spaced recesses (not shown) provided on the bottom edge 4 of a facing panel above. The bearing pads and the recesses are preferably such as to provide height adjustment of the upper facing panel, so as to achieve precise positioning thereof during construction. For example, the bottom surface of the recesses and the bottom surface of the bearing pads may each be helically sloped and arranged to interengage so that turning of the bearing bad results in adjustment of the level of its top surface. This provides vertical adjustment of the facing panel at the two laterally spaced locations of the pair of bearing pads.

A preferred facing panel having the form shown in FIGS. 1 to 8 has a general thickness of 9 cm, increasing to 17 cm where the ribs 9 are provided. The panel has a height of 210 cm and a width of 170 cm.

The erection sequence for a plurality of facing panels which are to form a facing will be described with reference to FIG. 9. A first row of half-height facing panels 1*a* is installed in a line along a suitably prepared site. The panels 1*a* are spaced from each other by a distance equal to a panel width. Facing panels 1*b* belonging to a second row thereof are lowered into the spaces between the half-height panels 1*a*. Earth is placed behind the facing panels 1*a* and 1*b* up to the level of the lowermost pairs of connecting lugs 10*x* and earth stabilising members, preferably in the form of strips, are then attached to these connecting lugs. Earth is placed on the row of stabilising members and this ensures that the panels 1*b* are securely held in position. Facing panels 1*c* belonging to a third row thereof are lowered into the spaces between the panels 1*b* to rest on the half-height panels 1*a*. The panels are backfilled with earth up to the level of the connecting lugs 10*y* on the panels 1*b*, to which earth stabilising members are then connected. Backfilling takes place up to the level of the lowermost connecting lugs 10*x* on the panels 1*c*, earth stabilising members are connected to those lugs 10*x*, backfilling takes place up to the level of the uppermost connecting lugs 10*z* on panels 1*b*, and earth stabilising members are connected to those lugs 10*z*. These steps continue as further rows of panels are installed. Clamps may be used if desired to adjust the position of each panel to obtain perfect alignment.

Considering the panel shown as 1*c* in FIG. 9, it will be appreciated that this has at the rear portion of each side edge a lower abutment 7 which engages in front of the lateral projections 8 at the rear of the side edges of the spaced apart facing panels 1*b*. The facing panel 1*c* also has at the rear of its side edges a lateral projection which engages behind an upper abutment 6 of each of the spaced apart facing panels 1*b*. Thus, at each side edge of panel 1*c*, its lateral projection 8 restrains forward movement thereof relative to the laterally adjacent facing panel 1*b*, whilst the lower abutment 7 thereof restrains rearward movement of the facing panel 1*c* relative to the laterally adjacent facing panel 1*b*. This occurs before facing panel 1*c* has been connected to its earth stabilising members. Before this connection takes place there remains the possibility that the facing panel 1*c* can rotate about a horizontal axis where its lateral projections 8 rest on the lateral projections 8 of the adjacent facing panels 1*b*, with forward movement at the bottom of facing panel 1*c*. Accordingly, before panel 1*c* is lowered a pair of shear resistant bearing pads 12 are positioned in the recesses 11 at the top edge 3 of half-height panel 1*a*, the inserts 12 mating in corresponding recesses in the bottom edge 4 of facing panel 1*c* when this is lowered. As described earlier, the bearing pads 12 are turned to adjust the position of facing panel 1*c*. Once the panel 1*c* has been lowered the bearing pads provide a shear connection between it and half-height panel 1*a*.

Thus, the facing panel is stably positioned before it has been connected to any earth stabilising members. Moreover, the side edges of the panels ensure that there is proper guidance as each panel is lowered and also allow the erection of the facing in a staggered manner as described.

Referring to FIG. 13, this shows an alternative form of facing panel which is generally "T" shaped in rear elevation but, like the first embodiment, is substantially rectangular in front elevation. Each side edge 34 of the facing panel 42 has a rear portion comprising a lateral projection 38 over the upper half of its length and an abutment 36 over the lower half of its length. The shapes of the lateral projection 38, the abutment 36 and a chamfer at the front of the panel, when viewed in horizontal cross-section, may for example be the same as those of the corresponding parts of the panel shown in FIGS. 1 to 8.

The erection sequence for the panels of FIG. 13 is generally the same as that described with reference to FIG. 9. However, it will be noted that panel 42 is restrained from rearward movement relative to the laterally adjacent panels 42 by engagement of its abutments 36 in front of the lateral projections 38 of the panels 42. However, at the stage of the construction sequence illustrated (panels 42 which are shown chain-dotted not yet being installed), the engagement of the side edges is not such as to restrain facing panel 42 from forward movement and consequently it is necessary to use simple clamps 40 between panels 42 and 42. These clamps can be temporary, since once earth stabilising members have been attached to panel 42, it is held securely in place. In the completed facing, the lateral projections 38 of panel 42 will engage behind corresponding abutments 36 of the facing panels 42 belonging to the next row thereof.

FIGS. 10 to 12 are concerned with the moulds for manufacturing facing panels, which are preferably moulded using a hardenable material such as concrete. FIG. 10 shows a cross section through a mould 20 for moulding the preferred embodiments of the present invention. On the left of FIG. 10 the cross section is through a part of the mould which is to form the lateral projection 8, whilst on the right of FIG. 10 the cross section is through another part of the mould which is to form an abutment 6 or 7. The mould 20 is in one piece and involves the use of simple, separate moulding blocks 21, made for example of PVC, which each occupy a portion of the mould to define a respective abutment 6 or 7. Four such blocks are required for the panel of FIGS. 1 to 8, and two for the panel of FIG. 14. Once the moulding material has hardened the moulding blocks are simply removed with the moulded facing panel from the mould, they are separated from the facing panel and can then be reused. In view of the simple form of the bottom and top edges of the facing panel, easy removal is possible. The recesses in the top and bottom edges of the mould may be formed by magnetic moulding blocks which can hold themselves in position in a steel mould, or the recesses may be formed by retractable members of conical form.

FIG. 11 shows a mould 22 for making a known facing panel with a tongue and groove type connection at its side edges. This mould 22 has removable walls 23 which have to be unbolted, disassembled, cleaned and reassembled for each fabrication of a new facing element.

FIG. 12 shows a mould 24 for making a known cruciform shaped facing panel. On the right of FIG. 12 the cross section is through a part of the mould which is to form one of the side branches of the cruciform panel, whilst on the left of FIG. 12 the cross section is through another part of the mould which is to form one of the recessed corner portions of the cruciform panel. Like mould 22, the mould 24 also has removable parts which must be disassembled to release the moulded facing panel from the mould, one of these parts being shown at 25.

It will therefore be appreciated that the mould shown in FIG. 10 is easier to use than the known moulding systems described with reference to FIGS. 11 and 12. Apart from the saving in time the removal of the disassembling-reassembling sequence results in a better quality product as there is no leakage of water and moulding material which can be a concern at points 30, 31 and 32 shown in FIGS. 11 and 12.

We claim:

1. A facing panel for assembly with like facing panels to form a facing of a stabilised earth structure, the facing panel having two opposite side edges defining substantially the height of the panel, said side edges provided for arrangement edge-to-edge with the side edges of laterally adjacent facing panels, each side edge having a front portion which is straight over substantially the full height of the facing panel, and a rear portion comprising a lateral projection over part of its length and an abutment over another part of its length, the lateral projection being provided for engagement behind a respective abutment on the side edge of a laterally adjacent facing panel to restrain forward movement of the facing panel, and the abutment being provided for engagement in front of a respective lateral projection of said laterally adjacent facing panel or of another laterally adjacent facing panel to restrain rearward movement of the facing panel.

2. A facing panel as claimed in claim 1, wherein each side edge rear portion has upper and lower abutments respectively over upper and lower parts of its length and a said lateral projection over an intermediate part of its length.

3. A facing panel as claimed in claims 1 or 2, wherein the top, bottom and side edges of the facing panel are such that it can be arranged in the facing in either one of two orientations.

4. A facing panel as claimed in claim 1 comprising means at the bottom edge of the facing panel for restraining forward or rearward movement thereof relative a facing panel therebelow.

5. A facing panel as claimed in claim 4, wherein said means for restraining comprises a shear resistant bearing pad which is separate from the main body of the facing panel and which in use is located, at least in part, in a recess formed in the bottom edge of the facing panel and, at least in part, in a recess formed in the top edge of the facing panel below.

6. A facing panel as claimed in claim 1 wherein the side edges are configured to permit adjacent facing panels to form a curve in plan view.

7. A facing panel as claimed in claim 1 having a front face which is rectangular.

8. A facing panel as claimed in claim 1 comprising means for connecting the facing panel to earth stabilising means behind the facing panel, wherein the thickness of the facing panel is greater at a region where the connecting means is provided than at a region where it is not provided.

9. A facing panel as claimed in claim 1 made by molding and having no insert molded therein other than means for connecting the facing panel to earth stabilising means behind the facing panel.

10. A facing panel for assembly with compatible side by side facing panels to form a facing wall of a mechanically stabilised earth structure comprising, in combination:

a rectangular panel having first and second side edges, a top edge and a bottom edge;

at least one side edge each having a straight line front portion from the top edge to the bottom edge, and having a rear portion with an abutment extending along the side edge partially between the top edge and bottom edge, said rear portion also including a lateral projection along the side edge extending partially between the top edge and bottom edge, said lateral projections of adjacent side by side panels positioned to oppose an abutment of the adjacent panel whereby the adjacent panels are interlocked.

11. A facing panel for assembly with compatible side by side facing panels as set forth in claim 10 wherein the abutments extend along the side edges and meet when assembled with an adjacent panel to limit sliding edge movement of adjacent side panels.

12. A facing panel for assembly with compatible side by side facing panels to form a facing wall of a mechanically stabilized earth structure comprising, in combination:

a panel having generally parallel, spaced side edges defining the height of the panel, each edge having a front portion and a rear portion, the front portion comprising a straight line segment along the height of the panel, and the rear portion including an abutment along a part of the rear portion and an adjacent rear projection along another part of the rear portion, said abutment and projection of adjacent, side by side panels engaging to hold the adjacent panels in position relative to one another in the forward and rearward direction.

13. A facing panel as claimed in claim 1 wherein a side edge portion has a lateral projection over the upper half of its length and an abutment over the lower half of its length.

14. A facing panel as claimed in claim 1 wherein each side edge rear portion has a lateral projection over the upper half of its length and an abutment over the lower half of its length.

15. A facing panel as claimed in claim 1 including restraining means at the bottom edge for restraining forward or rearward movement thereof relative to a facing panel therebelow.

16. A facing panel as claimed in claim 1 including restraining means at the bottom edge comprising a recess in the bottom edge for receipt of a projection from a facing panel therebelow to restrain forward or rearward movement of said panel.

17. A facing panel as claimed in claim 1 including a recess at the bottom edge for receipt of a projection therebelow to restrain forward or rearward movement of said panel.

18. A facing panel as claimed in claims 13 or 14 wherein said recess and projection is formed to restrain forward and rearward movement.

* * * * *